US009903386B2

(12) United States Patent
Yamasaki et al.

(10) Patent No.: US 9,903,386 B2
(45) Date of Patent: Feb. 27, 2018

(54) AIR CONDITIONING APPARATUS

(71) Applicant: DAIKIN INDUSTRIES, LTD., Osaka-shi, Osaka (JP)

(72) Inventors: Takahiro Yamasaki, Sakai (JP); Takashi Kashihara, Sakai (JP); Kaname Maruyama, Sakai (JP); Tsunehisa Sanagi, Sakai (JP); Naofumi Yokoyama, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 196 days.

(21) Appl. No.: 14/709,192

(22) Filed: May 11, 2015

(65) Prior Publication Data

US 2015/0330403 A1 Nov. 19, 2015

(30) Foreign Application Priority Data

May 15, 2014 (JP) ..... 2014-101149

(51) Int. Cl.

| | |
|---|---|
| ***F04D 29/28*** | (2006.01) |
| ***F04D 17/08*** | (2006.01) |
| ***F24F 7/007*** | (2006.01) |
| ***F04D 29/30*** | (2006.01) |
| ***F24F 1/48*** | (2011.01) |
| ***F24F 1/56*** | (2011.01) |

(52) U.S. Cl.

CPC ..... *F04D 29/281* (2013.01); *F04D 17/08* (2013.01); *F04D 29/30* (2013.01); *F24F 1/48* (2013.01); *F24F 1/56* (2013.01); *F24F 7/007* (2013.01)

(58) Field of Classification Search

CPC ..... F04D 29/281; F04D 29/282; F04D 29/28; F04D 29/26; F24F 1/48; F24F 1/56; F24F 7/007

See application file for complete search history.

(56) References Cited

U.S. PATENT DOCUMENTS

| | | | | |
|---|---|---|---|---|
| 6,042,335 A * | 3/2000 | Amr | ..... | F04D 29/282 415/173.1 |
| 6,931,868 B1 * | 8/2005 | Goldstein | ..... | F24F 5/0096 62/173 |
| 2003/0053911 A1 | 3/2003 | Sakai et al. | | |

FOREIGN PATENT DOCUMENTS

| | | | |
|---|---|---|---|
| JP | 6-281194 | A | 10/1994 |
| JP | 6-331169 | A | 11/1994 |
| JP | 2001-518174 | A | 10/2001 |
| JP | 2003-90298 | A | 3/2003 |
| WO | 98/31481 | A1 | 7/1998 |

* cited by examiner

*Primary Examiner* — Richard Edgar
(74) *Attorney, Agent, or Firm* — Global IP Counselors, LLP

(57) ABSTRACT

An air conditioning apparatus includes a casing having intake and blow-out ports, a partition member dividing an interior of the casing, a heat exchanger and a centrifugal fan. The centrifugal fan includes a hub and a bladed wheel having a plurality of rearward blades and sucks air existing in the heat exchanger compartment into the fan compartment through the fan entrance. The bladed wheel is mounted in the fan compartment such that a rotary shaft of the bladed wheel is oriented along an opening direction of the fan entrance and an opening direction of the blow-out port. The hub connects blow-out port side ends of the plural rearward blades and is configured to be rotated about the rotary shaft. The hub has an outer diameter smaller than an outer diameter of the rearward blades.

2 Claims, 15 Drawing Sheets

AIR CONDITIONING APPARATUS

CROSS-REFERENCE TO RELATED APPLICATIONS

This application claims priority under 35 U.S.C. § 119 to Japanese Patent Application No. 2014-101149, filed May 15, 2014. The entire disclosure of Japanese Patent Application. No. 2014-101149 is hereby incorporated herein by reference.

FIELD OF INVENTION

The present invention relates to an air conditioning apparatus, particularly to an air conditioning apparatus that a rearward bladed centrifugal fan is mounted in a fan compartment having a fan entrance bored in opposition to a blow-out port such that a rotary shall of the centrifugal fan is oriented to an opening direction of the fan entrance and an opening direction of the blow-out port.

BACKGROUND INFORMATION

As described in Japan Laid-open Patent Application Publication No. H06-281194, an air conditioning apparatus has been produced so far that a rearward bladed centrifugal fan is mounted in a ventilation unit (a fan compartment) having a fan entrance bored in opposition to a blow-out port such that a rotary shaft of the centrifugal fan is oriented to an opening direction of the fan entrance and an opening direction of the blow-out port.

SUMMARY

In the positional arrangement of the centrifugal fan in the fan compartment as described above, immediately after blown out by the bladed wheel of the centrifugal inn, air has a strong flow component directed in a radial direction. Hence, the radial flow component increases ventilation resistance in the fan compartment, and this serves as a factor of hindering enhancement in ventilation performance.

It is an object of the present invention to enhance the ventilation performance of a rearward bladed centrifugal fan in an air conditioning apparatus that the rearward bladed centrifugal fan is mounted in a fan compartment having a fan entrance bored in opposition to a blow-out port such that a rotary shaft of the rearward bladed centrifugal fan is oriented to an opening direction of the fan entrance and an opening direction of the blow-out port.

An air conditioning apparatus according to a first aspect includes a casing, a partition member, a heat exchanger and a centrifugal fan. The casing has an intake port and a blow-out port. The partition member divides an interior of the casing into a heat exchanger compartment located on an intake port side and a fan compartment located on a blow-out port side, and has a fan entrance that is bored in opposition to the blow-out port and makes the heat exchanger compartment and the fan compartment communicate with each other, The heat exchanger is mounted in the heat exchanger compartment. The centrifugal fan includes a bladed wheel having a plurality of rearward blades and is configured to suck air existing in the heat exchanger compartment into the fan compartment through the fan entrance, with the bladed wheel being mounted in the fan compartment such that a rotary shaft of the bladed wheel is oriented to an opening direction of the fan entrance and an opening direction of the blow-out port. Additionally, the bladed wheel further includes a hub that connects blow-out port side ends of the plural rearward blades and is configured to be rotated about the rotary shaft. Furthermore, the hub has an outer diameter smaller than an outer diameter of the rearward blades.

As described above, a type of bladed wheel, having the construction that the outer diameter of the hub is set to be smaller than that of the rearward blades, is herein employed as the bladed wheel of the centrifugal fun that is mounted in the fan compartment such that the rotary shaft thereof is oriented to the opening direction of the fan entrance and the opening direction of the blow-out port. With the construction, immediately after blown out by the bladed wheel of the centrifugal fan, air can be herein strengthened in its flow component directed in the axial direction, and simultaneously, can be weakened in its flow component directed in the radial direction. Thus, the tendency of oblique flow can be strengthened.

Consequently, the ventilation resistance in the fan compartment can be herein reduced, and the ventilation performance of the centrifugal fan can be enhanced.

An air conditioning apparatus according to a second aspect relates to the air conditioning apparatus according to the first aspect, and wherein the outer diameter of the rearward blades is greater than or equal to 0.75 times a hydraulic diameter of lateral parts of the casing that enclose an outer peripheral side of the bladed wheel. Additionally; the outer diameter of the hub is 0.91 to 0.96 times the outer diameter of the rearward blades.

The extent to which the ventilation resistance in the fan compartment is increased by the air that has just been blown out from the bladed wheel of the centrifugal fan is affected by the distance between the rearward blades and the lateral parts of the casing. Put differently, the ventilation resistance tends to increase with decrease in distance between the rearward blades and the lateral parts of the casing. On the other hand, the extent of oblique flow is affected by the outer diameter of the hub. Put differently, the tendency of oblique flow can be strengthened with decrease in outer diameter of the hub. It should be noted that when the outer diameter of the hub is extremely small, the ventilation function of the rearward blades itself is inevitably impaired. Due to the characteristics as described above, in employing a type of bladed wheel having the construction that the outer diameter of the hub is set to be smaller than that of the rearward blades, it is preferable to achieve the tendency of oblique flow without impairing the ventilation function of the rearward blades under the condition that the distance between the rearward blades and the lateral parts of the casing is short.

In view of the above, in employing a type of bladed wheel having the construction that the outer diameter of the hub is set to be smaller than that of the rearward blades, the outer diameter of the hub is herein set, as described above, to be 0.91 to 0.96 times the outer diameter of the rearward blades under the condition that the outer diameter of the rearward blades is greater than or equal to 0.75 times the hydraulic diameter of the lateral parts of the casing that enclose the outer peripheral side of the bladed wheel.

Consequently, in employing a type of bladed wheel that the outer diameter of the hub is set to be smaller than that of the rearward blades, the ventilation performance of the centrifugal fan can be herein effectively enhanced in view of the characteristics as described above.

An air conditioning apparatus according to a third aspect relates to the air conditioning apparatus according to the first or second aspect, and wherein a length Obtained by subtracting the outer diameter of the hub from the outer diameter of the rearward blades is less than or equal to 0.4 times a chord length, which is a length obtained by subtracting an inner diameter of the rearward blades from the outer diameter of the rearward blades.

In employing a type of bladed wheel that the outer diameter of the hub is set to be smaller than that of the rearward blades, the length obtained by subtracting the outer diameter of the huh from that of the rearward blades is herein set, as described above, to be less than or equal to 0.4 times the chord length.

Consequently, in employing a type of bladed wheel that the outer diameter of the hub is set to be smaller than that of the rearward blades, the rearward blades can be herein reliably supported by the hub, and the structural strength of the bladed wheel can be enhanced.

BRIEF DESCRIPTION OF THE DRAWINGS

Referring now to the attached drawings which form a part of this original disclosure.

DETAILED DESCRIPTION OF EMBODIMENTS

An air conditioning apparatus according to a preferred embodiment of the present invention will be hereinafter explained on the basis of the attached drawings. It should be noted that a specific construction of the air conditioning apparatus according to the present invention is not limited to the following preferred embodiment and the modifications thereof, and can be changed without departing from the scope of the present invention.

(1) Basic Construction of Air Conditioning Apparatus

Figure 1:
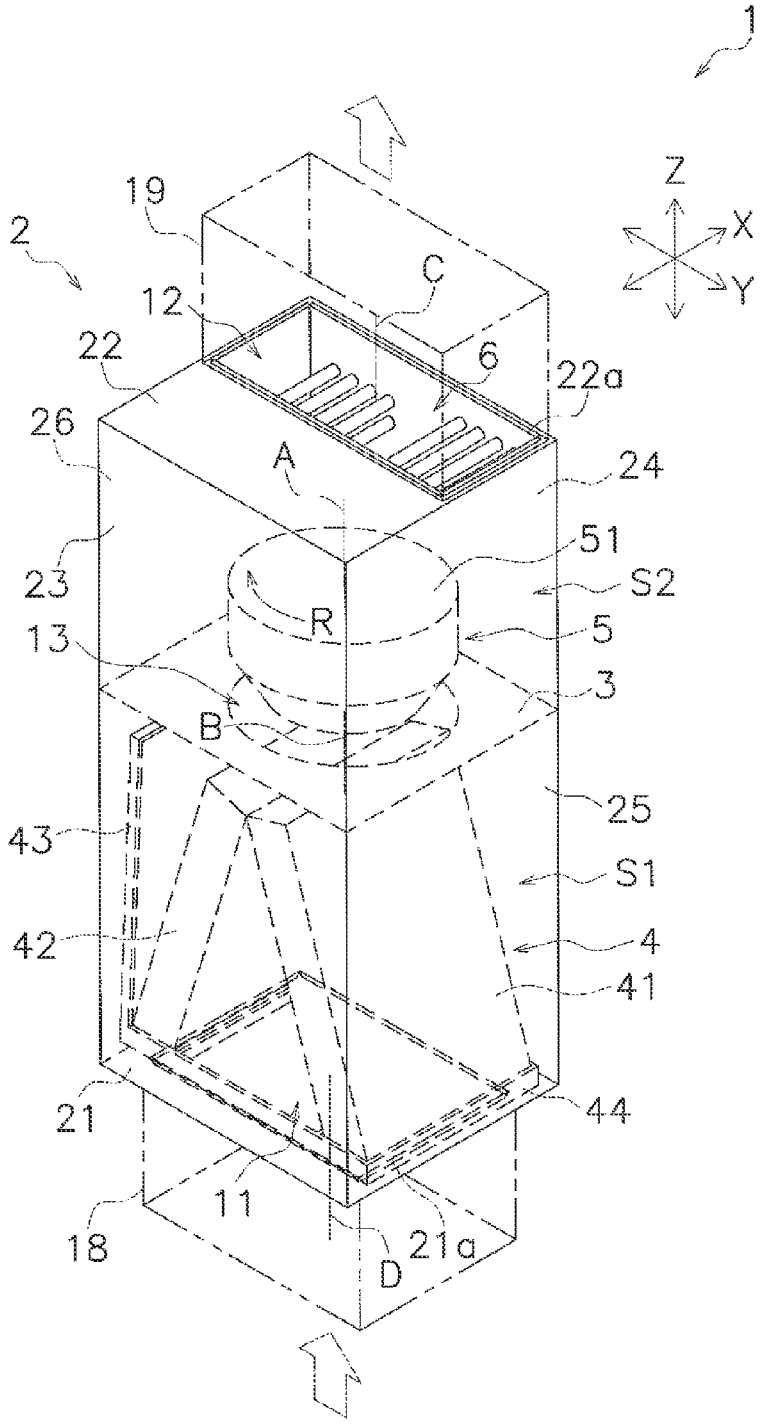
FIG. 1 is an external perspective view of an air conditioning apparatus according to a preferred embodiment of the present invention (in a vertical mount configuration)
Figure 2:
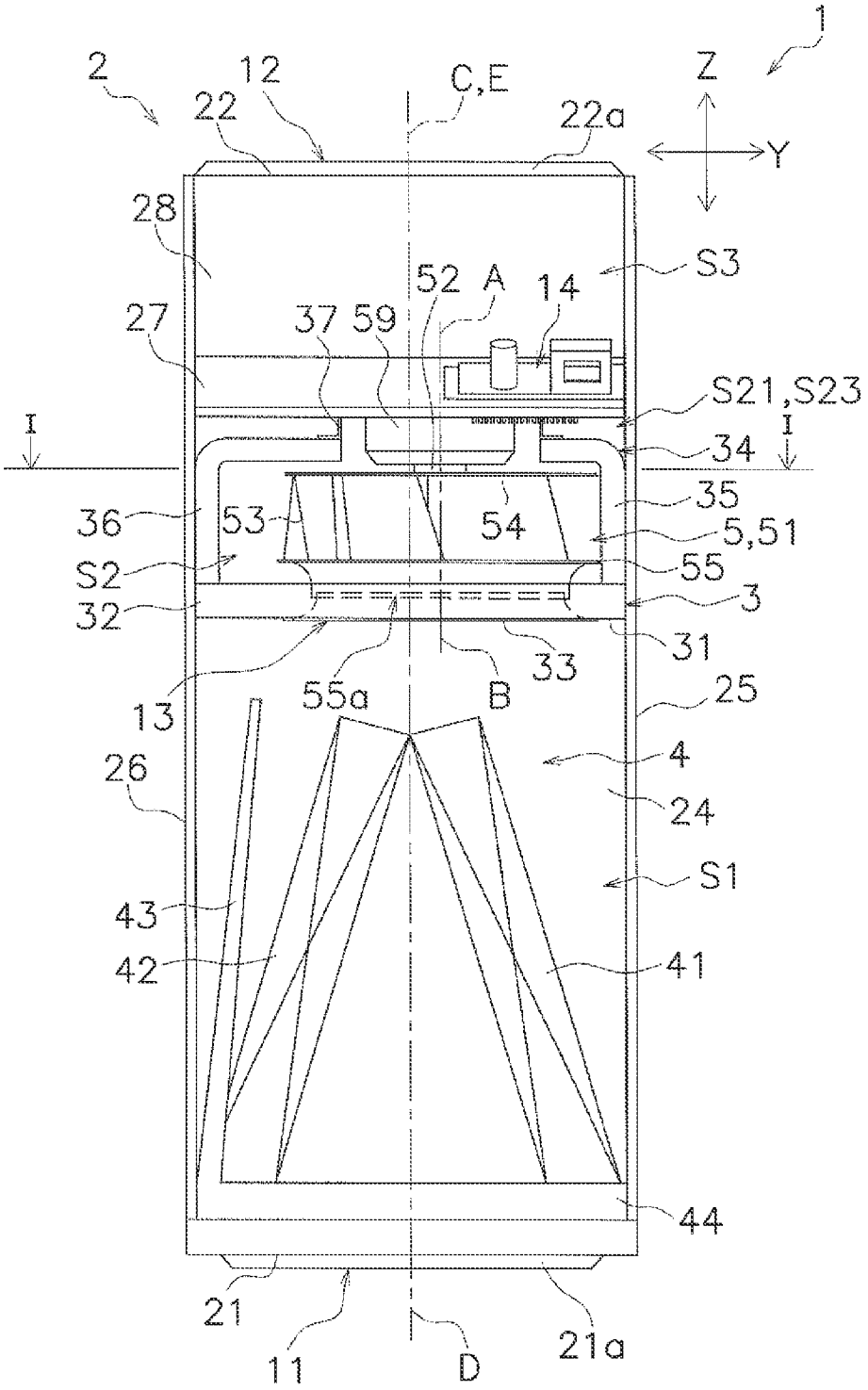
FIG. 2 is a front lateral view of the air conditioning apparatus from which a first lateral part is detached (in the vertical mount configuration)
Figure 3:
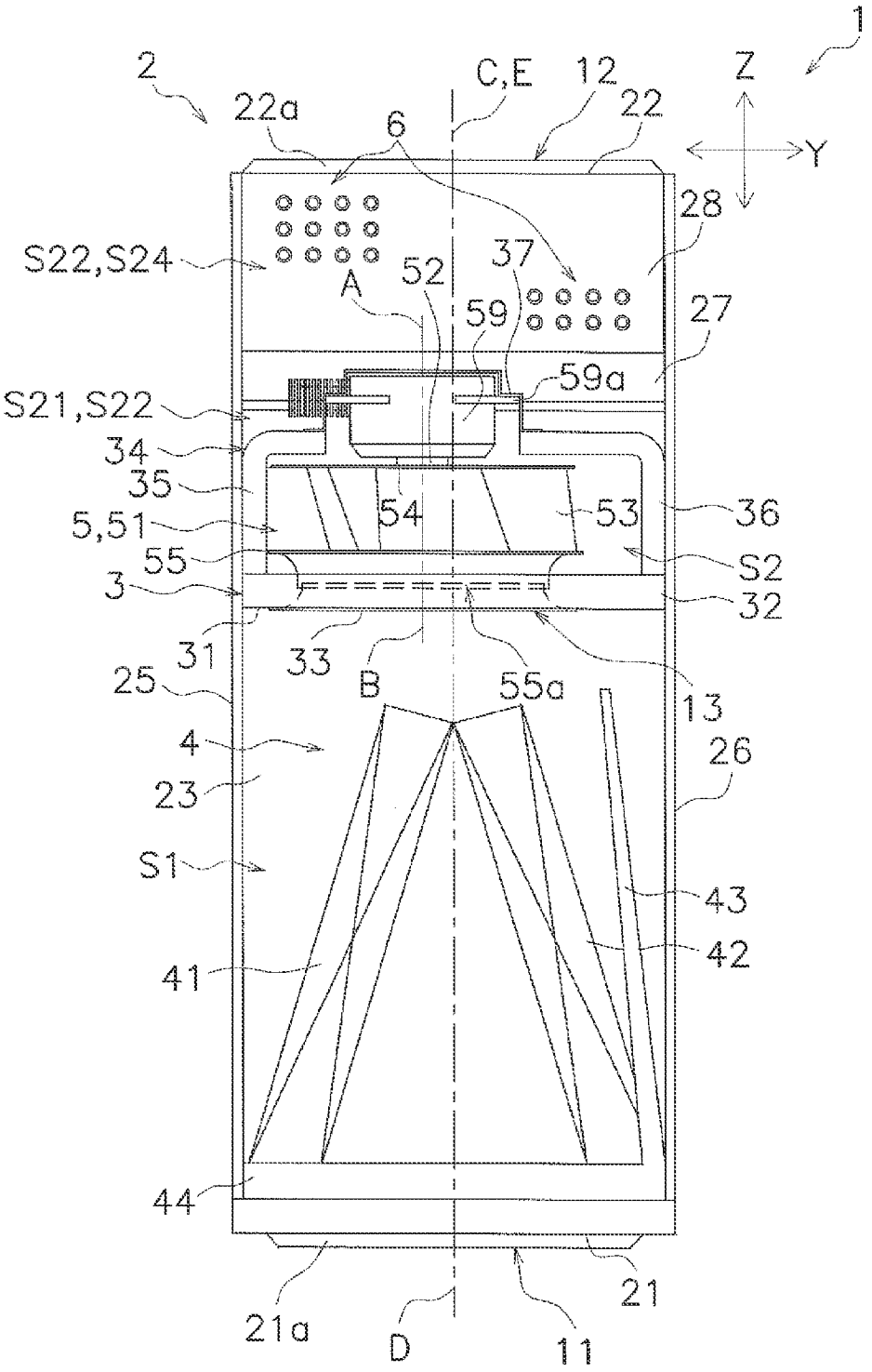
FIG. 3 is a rear lateral view of the air conditioning apparatus from which a second lateral part is detached (in the vertical mount configuration)
Figure 4:
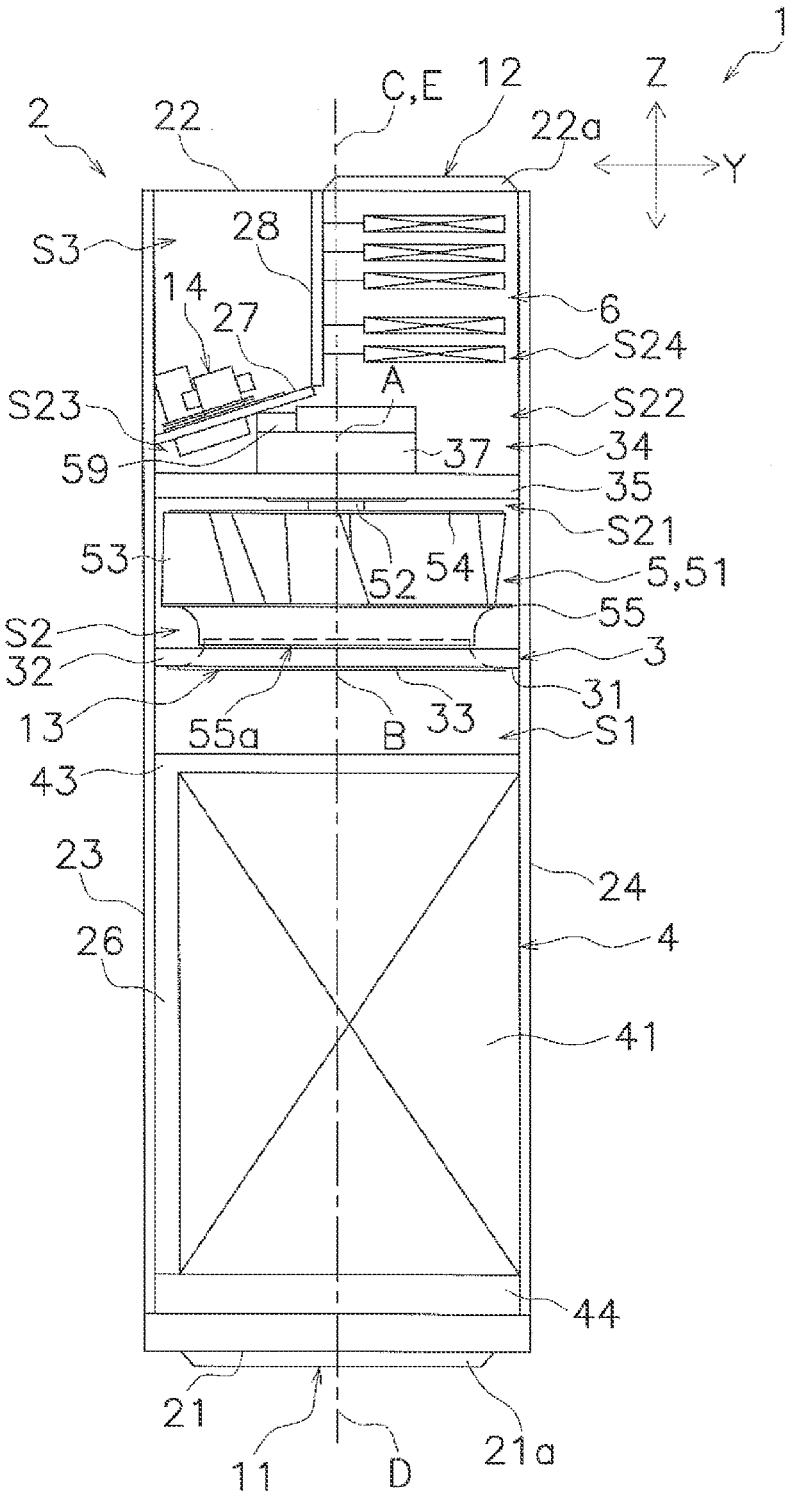
FIG. 4 is a right lateral view of the air conditioning apparatus from which a third lateral part is detached (in the vertical mount configuration)
Figure 5:
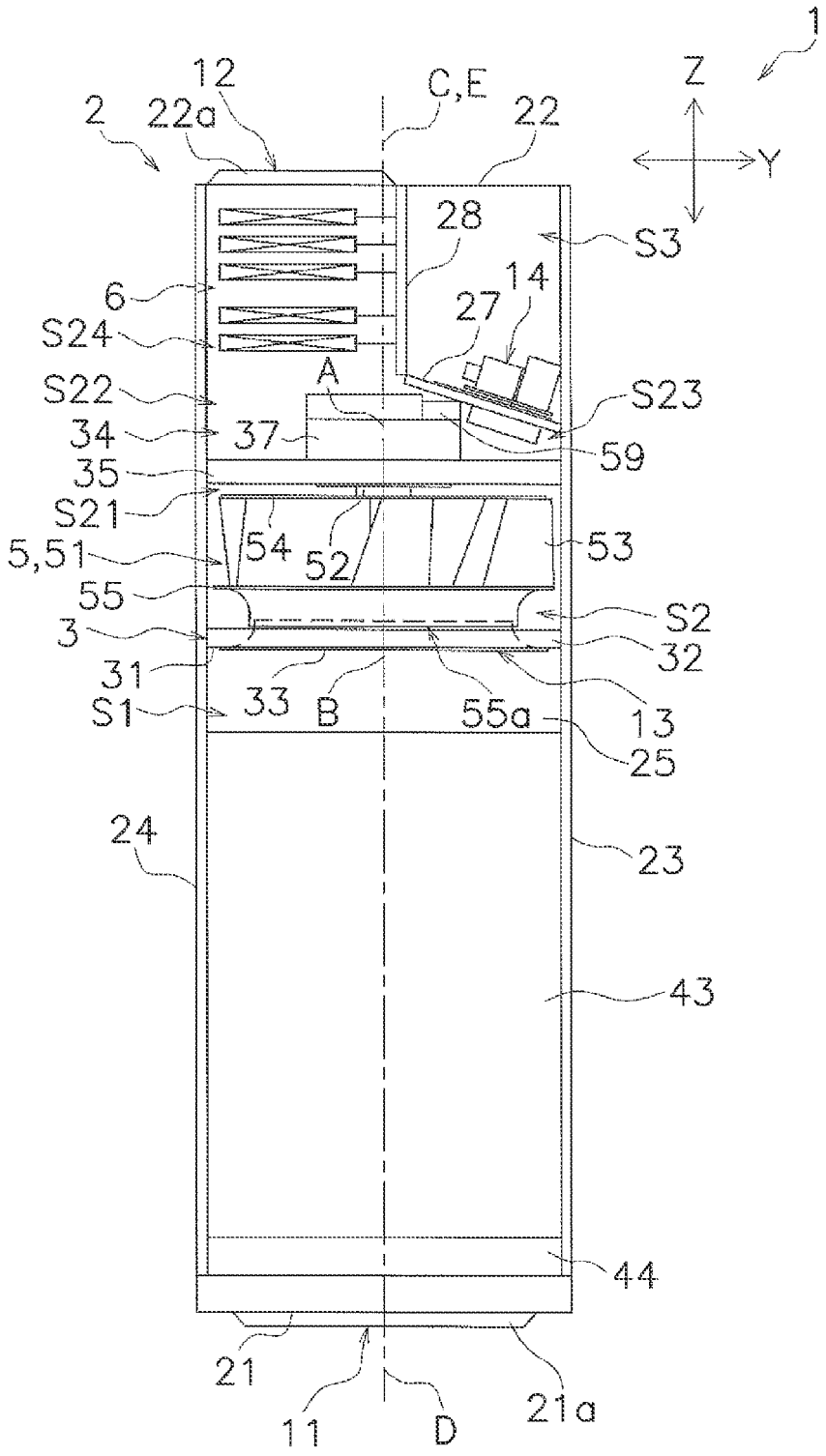
FIG. 5 is a left lateral view of the air conditioning apparatus from which a fourth lateral part is detached (in the vertical mount configuration)
Figure 6:
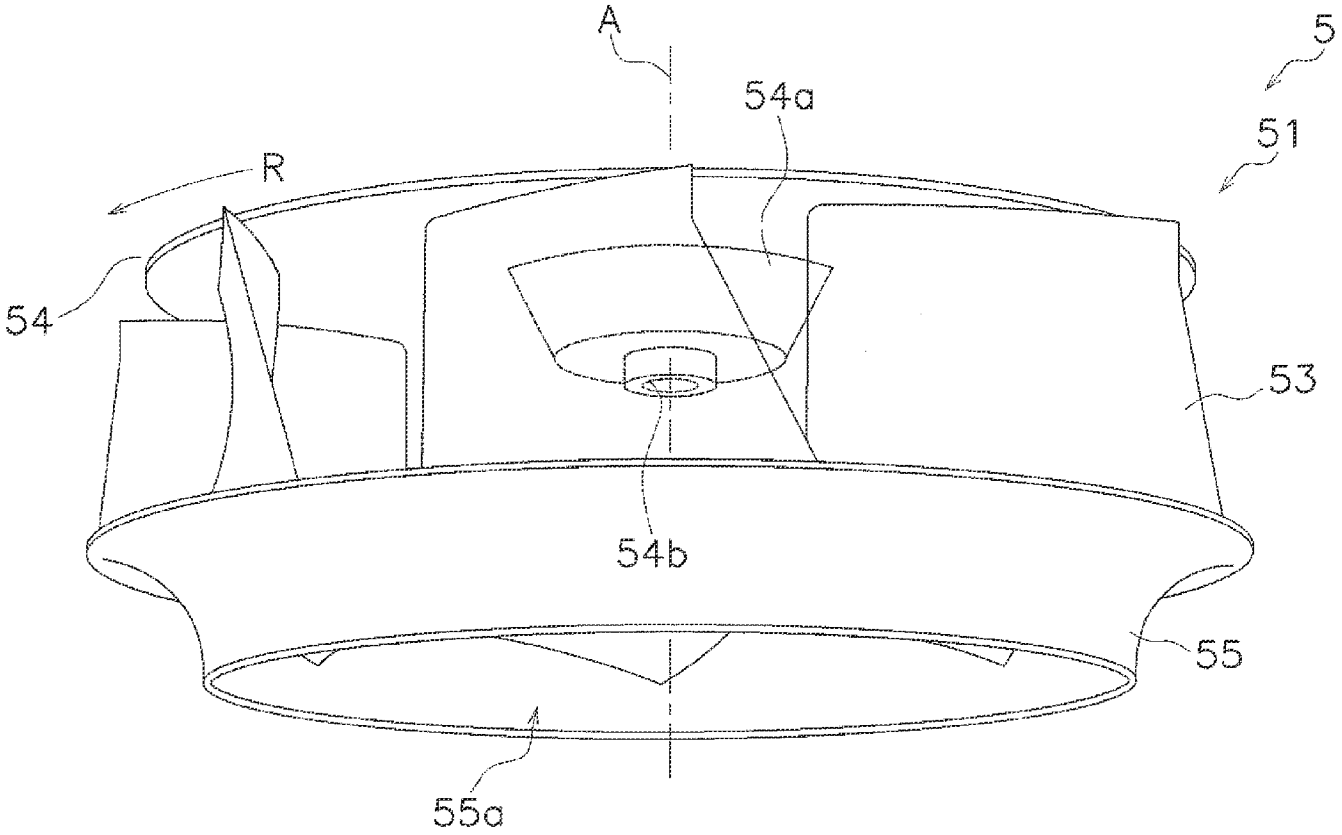
FIG. 6 is an external perspective view of a bladed wheel of a centrifugal fan.
Figure 7:
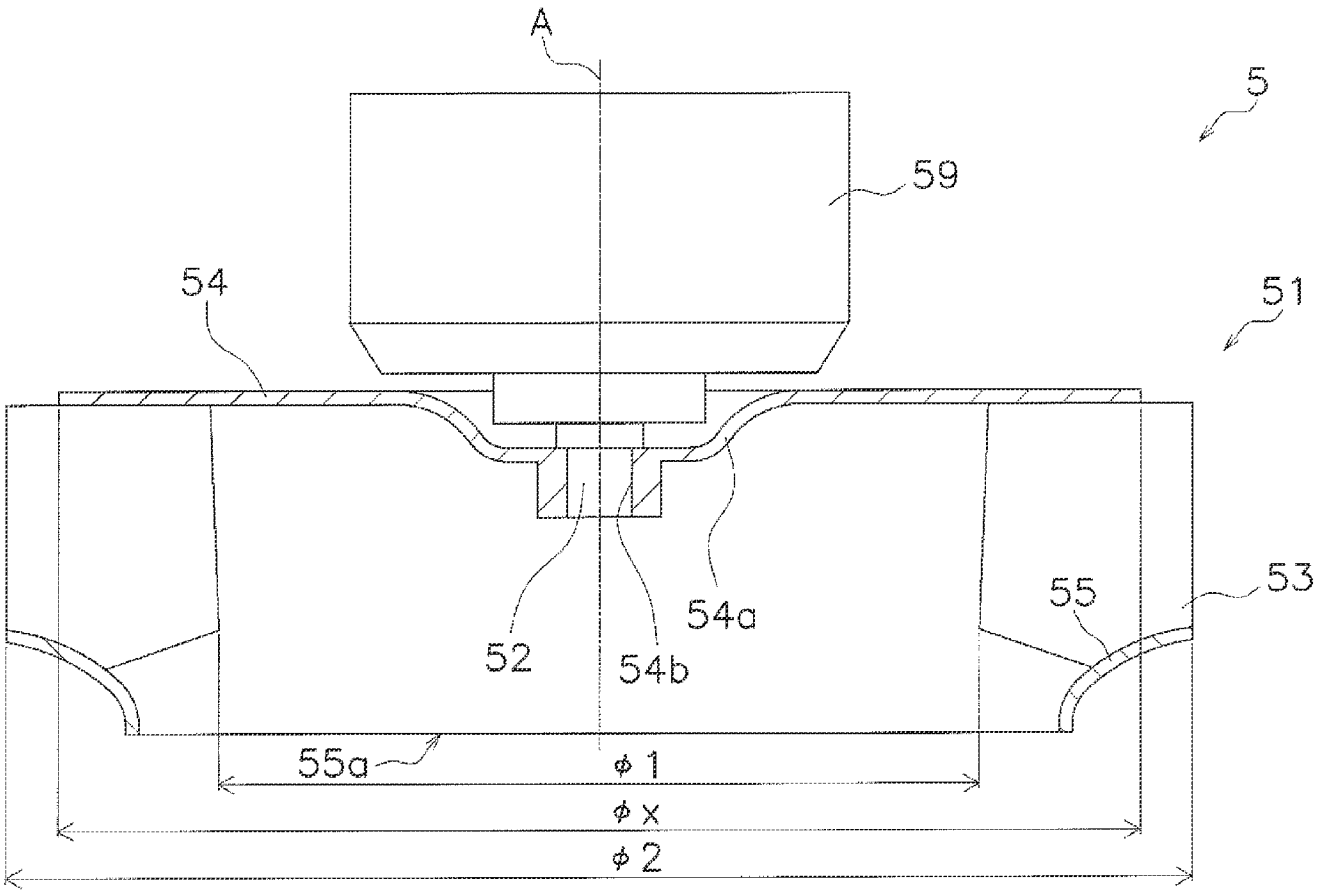
FIG. 7 is a schematic cross-sectional view of the centrifugal fan.
Figure 8:
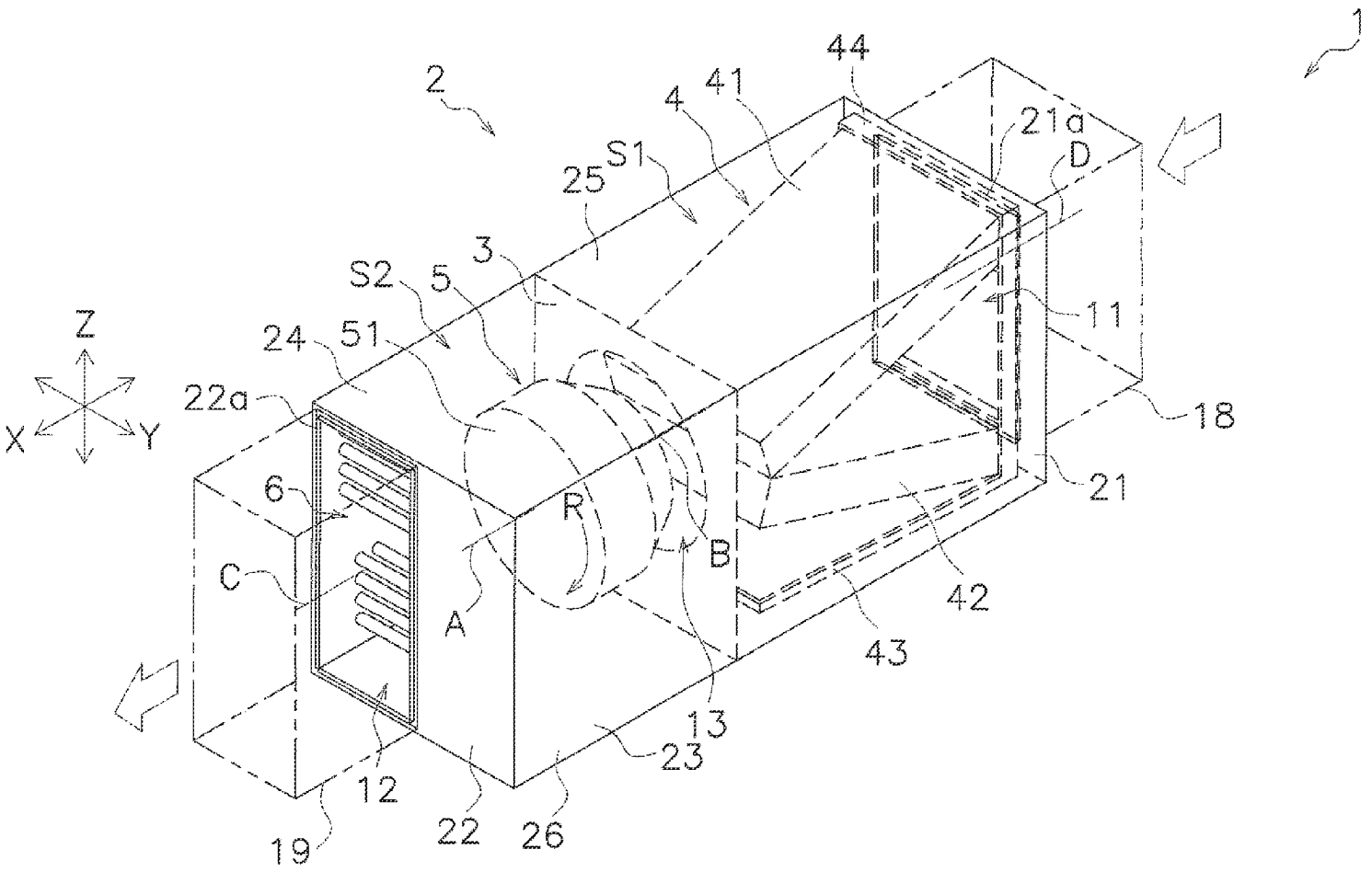
FIG. 8 is an external perspective view of the air conditioning apparatus (in a horizontal mount configuration)
Figure 9:
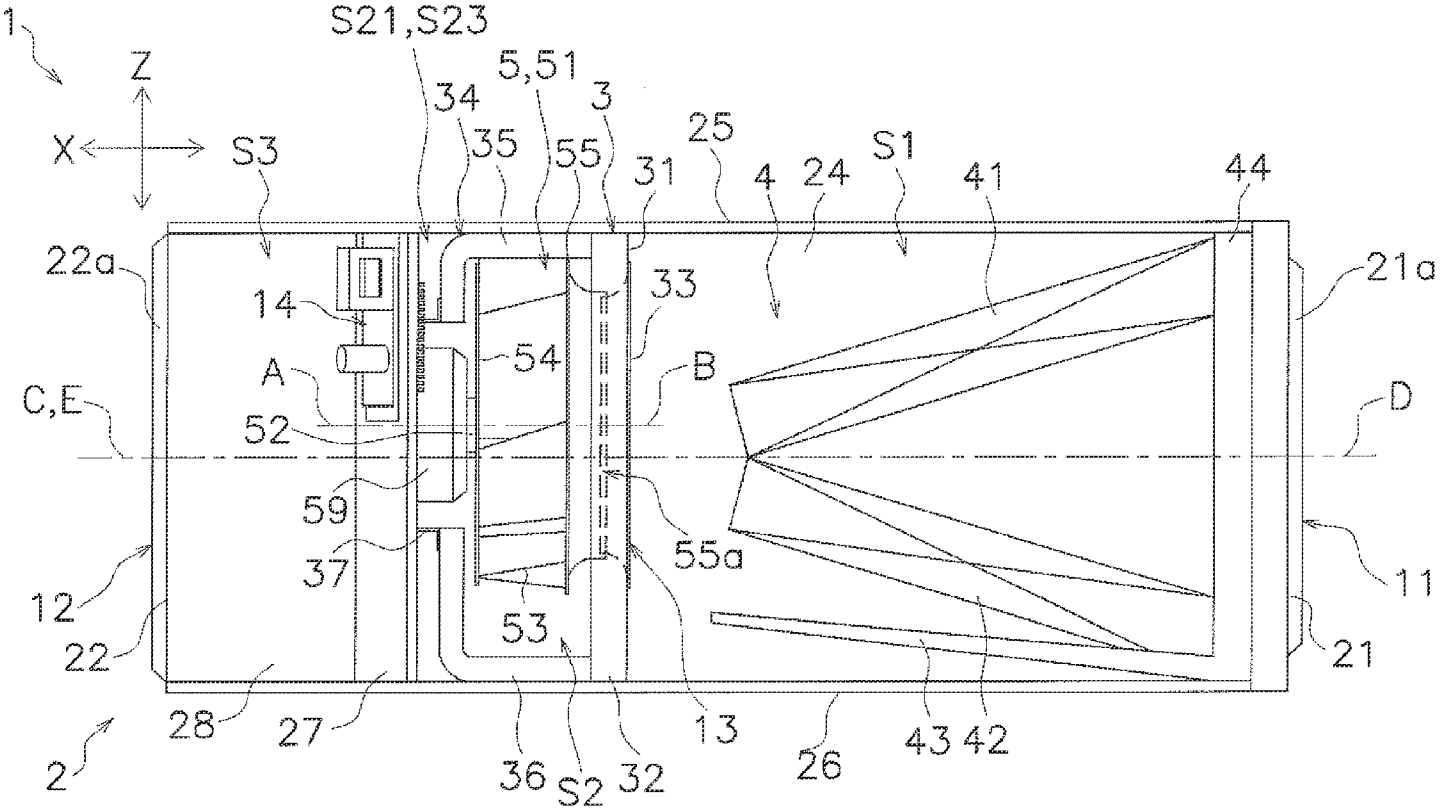
FIG. 9 is a right lateral view of the air conditioning apparatus from which the first lateral part is detached (in the horizontal mount configuration)

First, a basic construction of an air conditioning apparatus I will be explained with FIGS. 1 to 9. Here, FIG. 1 is an external perspective view of the air conditioning apparatus 1 according to the preferred embodiment of the present invention (in a vertical mount configuration). FIG. 2 is a front lateral view of the air conditioning apparatus 1 from which a first lateral part 23 is detached (in the vertical mount configuration). FIG. 3 is a rear lateral view of the air conditioning apparatus 1 from which a second lateral part 24 is detached (in the vertical mount configuration). FIG. 4 is a right lateral view of the air conditioning apparatus 1 from which a third lateral part 25 is detached (in the vertical mount configuration). FIG. 5 is a left lateral view of the air conditioning apparatus 1 from which a fourth lateral part 26 is detached (in the vertical mount configuration). FIG. 6 is an external perspective view of a bladed wheel of a centrifugal fan. FIG. 7 is a schematic cross-sectional view of the centrifugal fan 5. FIG. 8 is an external perspective view of the air conditioning apparatus 1 (in a horizontal mount configuration). FIG. 9 is a right lateral view of the air conditioning apparatus 1 from which the first lateral part 23 is detached (in the horizontal mount configuration).

The air conditioning apparatus 1 is an apparatus installed in a building in order to perform a cooling operation and a heating operation for the indoor space of the building. The air conditioning apparatus 1 includes a casing 2, a partition member 3, a heat exchanger 4 and a centrifugal fan 5. The casing 2 has an intake port 11 and a blow-out port 12. The partition member 3 divides the interior of the casing 2 into a heat exchanger compartment S1 located on the intake port 11 side and a fan compartment S2 located on the blow-out port 12 side, and has a fan entrance 13 making the heat exchanger compartment S1 and the fan compartment S2 communicate with each other. The heat exchanger 4 is mounted in the heat exchanger compartment Si. The centrifugal fan 5 includes a bladed wheel 51 having a plurality of rearward blades 53 and is configured to suck air existing in the heat exchanger compartment S1 into the fan compartment S2 through the fan entrance 13, with the bladed wheel 51 being mounted in the fan compartment S2 such that a rotary shaft 52 (its axis will be referred to as a rotary axis A) is oriented to an opening direction B of the fan entrance 13.

Moreover, the fan entrance 13 is herein opposed to the blow-out port 12, and the rotary shaft 52 (the rotary axis A) of the bladed wheel 51 is oriented to the opening direction B of the fan entrance 13 and an opening direction C of the blow-out port 12. Furthermore, the intake port 11 is herein opposed to the fan entrance 13, and the rotary shaft 52 (the rotary axis A) of the bladed wheel 51 is oriented to the opening direction B of the fan entrance 13, the opening direction C of the blow-out port 12 and an opening direction D of the intake port 11.

Moreover, the air conditioning apparatus 1 is herein capable of taking two configurations, i.e., the vertical mount configuration and the horizontal mount configuration. in the vertical mount configuration, the casing 2 is disposed such that the rotary shaft 52 (the rotary axis A) of the bladed wheel 51 is oriented to a vertical direction Z (see FIGS. 1 to 5). In the horizontal mount configuration, the casing 2 is disposed such that the rotary shaft 52 (the rotary axis A) of the bladed wheel 51 is oriented to a horizontal direction X (see FIGS. 8 and 9).

As described above, the casing 2 has the intake port 11 and the blow-out port 12. The casing 2 is mainly composed of an upstream lateral part 21, a downstream lateral part 22, the first lateral part 23, the second lateral part 24, the third lateral part 25 and the fourth lateral part 26. These lateral parts 21 to 26 form the elongated cuboid casing 2. The upstream lateral part 21 is a member configured to form the bottom lateral surface of the casing 2 in the vertical mount configuration and form the rear lateral surface of the casing 2 in the horizontal mount configuration. The downstream lateral part 22 is a member configured to form the top lateral surface of the casing 2 in the vertical mount configuration and form the front lateral surface of the casing 2 in the horizontal mount configuration. The upstream lateral part 21 and the downstream lateral part 22 are disposed away from each other in the lengthwise direction of the casing 2 (i.e., a direction along the rotary axis A and the opening directions B, C and D). The upstream lateral part 21 has the intake port 11. The intake port 11 is an opening bored in the middle of the upstream lateral part 21 and is made in the form of a rectangular aperture. The downstream lateral part 22 has the blow-out port 12. The blow-out port 12 is an opening bored in the downstream lateral part 22 so as to be displaced from the middle of the downstream lateral part 22, and is made in the form of a rectangular aperture. The blow-out port 12 is herein located in a position close to the second lateral part 24 within the downstream lateral part 22. The first lateral part 23 is a member configured to form the front lateral surface of the casing 2 in the vertical mount configuration and form the right lateral surface of the casing 2 in the horizontal mount configuration. The second lateral part 24 is a member configured to form the rear lateral surface of the casing 2 in the vertical mount configuration and form the left lateral surface of the casing 2 in the horizontal mount configuration. The first lateral part 23 and the second lateral part 24 are disposed away from each other in a direction orthogonal to the lengthwise direction of the casing 2 (i.e., the horizontal direction X orthogonal to the rotary axis A and the opening directions B, C and D in the vertical mount configuration; a right-and-left direction Y orthogonal to the rotary axis A and the opening directions B, C and D in the horizontal mount configuration). The third lateral part 25 is a member configured to from the right lateral surface of the casing 2 in the vertical mount configuration and form the top lateral surface of the casing 2 in the horizontal mount configuration. The fourth lateral part 26 is a member configured to form the left lateral surface of the casing 2 in the vertical mount configuration and form the bottom lateral surface of the casing 2 in the horizontal mount configuration. The third lateral part 25 and the fourth lateral part 26 are disposed away from each other in a direction orthogonal to the lengthwise direction of the casing 2 (i.e., the right-and-left direction Y orthogonal to the rotary axis A and the opening directions B and C in the vertical mount configuration; the vertical direction Z orthogonal to the rotary axis A and the opening directions B, C and D in the horizontal mount configuration).

Moreover, a plurality of ridges 21*a* are herein formed on the upstream lateral part 21 so as to enclose the circumferential edges of the intake port 11, whereas a plurality of ridges 22*a* are formed on the downstream lateral part 22 so as to enclose the circumferential edges of the blow-out port 12. Furthermore, an intake duct 18 is connected to the intake port 11 through the ridges 21*a*, whereas a blow-out duct 19 is connected to the blow-out port 12 through the ridges 22*a*. With the construction, the air conditioning apparatus 1 is herein configured to be of a duct connection type for sucking and blowing air from and to an air-conditioned room indirectly through the ducts 18 and 19. It Should be herein noted that the intake port 111 and the blow-out port 12 are made in forms of rectangular apertures, and likewise, the ducts 18 and 19 are made in forms of rectangular tubes. However, the ports 11 and 12 and the ducts 18 and 19 are not limited to be made in the aforementioned forms, and may employ a variety of forms. Furthermore, the air conditioning apparatus 1 is not limited to be of the duct connection type, and may be of a variety of types such as a type for sucking and blowing air from and to an air-conditioned room directly through the intake port 11 and the blow-out port 12.

As described above, the partition member 3 divides the interior of the casing 2 into the heat exchanger compartment S1 located on the intake port 11 side and the fan compartment S2 located on the blow-out port 12 side, and has the fan entrance 13 that makes the heat exchanger compartment S1 and the fan compartment S2 communicate with each other, The partition member 3 is mainly composed of a partition body 31 made in the form of a rectangular plate. The partition body 31 is disposed in parallel to a direction orthogonal to the lengthwise direction of the casing 2 (i.e., a direction orthogonal to the rotary axis A and the opening directions B, C and D). The fan entrance 13 is bored in the partition body 31 and is herein made in the form of a circular aperture. The partition body 31 has a partition circumferential part 32 made in the form of a rectangular frame. The partition circumferential part 32 extends from the circumferential edges of the partition body 31 toward the fan compartment S2 along the inner surfaces of the lateral parts 23 to 26 of the casing 2.

As described above, the heat exchanger 4 is mounted in the heat exchanger compartment S1. In a cooling operation, the heat exchanger 4 is configured to cool air flowing through the heat exchanger compartment S1 by a refrigerant. Contrarily in a heating operation, the heat exchanger 4 is also capable of heating air flowing through the heat exchanger compartment S1 by the refrigerant. A fin tube heat exchanger, composed of multiple fins and a heat transfer tube, is herein employed as the heat exchanger 4. Furthermore, the refrigerant is configured to be supplied to the heat exchanger 4 from an outdoor unit installed outside the building or so forth. The heat exchanger 4 is composed of a part 41 located closely to the third lateral part 25 of the casing 2 and a part 42 located closely to the fourth lateral part 26 of the casing 2. Moreover, the part 41 of the heat exchanger 4, located closely to the third lateral part 25, is disposed in a tilt position so as to get closer to the third lateral part 25 from a side near to the fan entrance 13 to a side near to the intake port 11. The part 42 of the heat exchanger 4, located closely to the fourth lateral part 26, is disposed in a tilt position so as to get closer to the fourth lateral part 26 from the side near to the fan entrance 13 to the side near to the intake port 11. With the construction, the heat exchanger 4 has a V shape so as to get closer to the third lateral part 25 and the fourth lateral part 26 of the casing 2 from the side near to the fan entrance 13 to the side near to the intake port 11. It should be noted that the heat exchanger 4 is not limited to have the V shape, and may employ a variety of shapes.

Moreover, drain pans 43 and 44 are mounted in the heat exchanger compartment S1 in order to receive water produced by dew condensation in the heat exchanger 4. The first drain pan 43 is configured to be used when the casing 2 is disposed such that the rotary shaft 52 (the rotary axis A) of the bladed wheel S1 is oriented to the horizontal direction X (in the horizontal mount configuration). The second drain pan 44 is configured to be used when the casing 2 is disposed such that the rotary shaft 52 (the rotary axis A) of the bladed wheel 51 is oriented to the vertical direction Z (in the vertical mount configuration). The first drain pan 43 is disposed in a position close to the fourth lateral part 26, which is one of the lateral parts 23 to 26 of the casing 2 that are disposed along the opening direction B of the fan entrance 13. With the construction, the first drain pan 43 is configured to be disposed over the fourth lateral part 26 forming the bottom lateral surface of the casing 2 and receive the bottom side of the heat exchanger 4 in the horizontal mount configuration. The second drain pan 44 is disposed in a position close to the upstream lateral part 21, which is one of the lateral parts 21 and 22 of the casing 2 that are disposed along the direction orthogonal to the opening direction B of the fan entrance 13. With the construction, the second drain pan 44 is configured to be disposed over the upstream lateral part 21 forming the bottom lateral surface of the casing 2 and receive the bottom side of the heat exchanger 4 in the vertical mount configuration. Furthermore, the first and second drain pans 43 and 44 are herein compatible with the vertical mount configuration and the horizontal mount configuration, but the first drain pan 43 to be used in the horizontal mount configuration exists in the heat exchanger compartment S1 even in the vertical mount configuration, whereas the second drain pan 44 to be used in the vertical mount configuration exists in the heat exchanger compartment S1 even in the horizontal mount configuration.

As described above, the centrifugal fan 5 includes the bladed wheel 51 having the plural rearward blades 53 and is configured to suck air existing in the heat exchanger compartment S1 into the fan compartment S2 through the fan entrance 13, with the bladed wheel 51 being mounted in the fan compartment S2 such that the rotary shaft 52 (the rotary axis A) is oriented to the opening direction B of the fan entrance 13. Furthermore, a fan motor 59 is mounted in the fan compartment S2 in order to drive and rotate the bladed wheel 51. Here in the fan compartment 2, the bladed wheel 51 is disposed proximally to the fan entrance 13 and the fan motor 59 is disposed on the downwind side of the bladed wheel 51 along the rotary shaft 52 (the rotary axis A) of the bladed wheel 51. Moreover, a bell mouth 33 is mounted to the fan entrance 13. A space, located on the downwind side of the bladed wheel 51 in the fan compartment S2, is herein defined as a fan downwind space S21. Thus, the fan motor 59 is disposed in the fan downwind space S21.

The bladed wheel 51 is composed of a hub 54, a shroud 55 and the plural rearward blades 53 disposed between the hub 54 and the shroud 55. The hub 54 connects the blow-out port 12 side ends of the plural rearward blades 53, and is configured to be rotated about the rotary shaft 52 (the rotary axis A), The hub 54 is a disc-shaped member and has a hub protrusion 54*a* protruding from its middle toward the shroud 55. The hub protrusion 54*a* is coupled to the fan motor 59. The rotary shaft 52 of the fan motor 59 is herein fixed to a shaft hole 54*b* formed in the middle of the hub protrusion 54*a*. The shroud 55 is disposed on the fan entrance 13 side of the hub 54 so as to be opposed to the hub 54, connects the fan entrance 13 side ends of the plural rearward blades 53, and is configured to be rotated about the rotary shaft 52. (the rotary axis A). The shroud 55 is an annular member and has a fan opening 55*a* that is bored in the thrill of a circular aperture and is centered at the rotary shaft 52 (the rotary axis A). The shroud 55 has a curved shape that its outer diameter increases toward a side near to the hub 54. The plural rearward blades 53 are disposed between the huh 54 and the shroud 55 so as to be aligned at predetermined intervals along the circumferential direction of the rotary shaft 52 (the rotary axis A). Each rearward blade 53 tilts oppositely to a rotary direction R of the bladed wheel 51 (herein a clockwise direction in a view seen from the blow-out port 12 side) with respect to the radial direction of the hill) 54.

The bell mouth 33 is mounted to the fan entrance 13 of the partition member 3 so as to be opposed to the fan opening 55*a* of the bladed wheel 51 and directs air, flowing thereto from the heat exchanger compartment S1, to the fan opening 55*a* of the bladed wheel 51. The bell mouth 33 is an annular member centered at the rotary shaft 52 (the rotary axis A). The bell mouth 33 has a curved shape that its outer diameter decreases toward a side near to the shroud 55.

The fan motor 59 is disposed concentrically to the rotary shaft 52 (the rotary axis A) of the bladed wheel 51 in the fan downwind space S21. The fan motor 59 has a columnar shape centered at the rotary shaft 52 (the rotary axis A). The fan motor 59 is herein fixed to the partition member 3 through a motor support base 34. Specifically, the motor support base 34 is composed of support frames 35 and 36 forming a roughly squared U shape. The support frames 35 and 36 respectively extend toward the vicinity of the outer peripheral surface of the fan motor 59 from parts of the partition circumferential part 32 of the partition member 3, i.e., a part located closely to the third lateral part 25 of the casing 2 and a part located closely to the fourth lateral part 26 of the casing 2. Moreover, the fan motor 59 is fixed at its end plate parts 59*a* to the support frames 35 and 36 through a bracket 37. The end plate parts 59*a* extend from the outer peripheral surface of the fan motor 59 toward the third lateral part 25 and the fourth lateral part 26. Thus, the centrifugal fan 5, including the bladed wheel 51 and the fan motor 59, is designed to be fixed to the partition member 3 through the motor support base 34. With the construction, the entirely of the centrifugal fan 5 is configured to be detachable by detaching the partition member 3 from the casing 2 in performing a maintenance work or so forth.

Moreover, the fan downwind space S21 of the fan compartment S2 has a blow-out port opposed space S22 as a region opposed to the blow-out port 12. The blow-out port 12 is herein disposed in the position close to the second lateral part 24 within the downstream lateral part 22. Thus, when the casing 2 is seen from the blow-out port 12. side, the blow-out port opposed space S22 is formed by a space enclosed by parts located along the circumferential edges of the opening of the blow-out port 12, i.e., the second lateral part 24, a part of the third lateral part 25 that is located closely to the second lateral part 24, and a part of the fourth lateral part 26 that is located closely to the second lateral part 24. Furthermore, a blow-out port non-opposed surface part 27 is mounted in a position on the downwind side of the bladed wheel 51 so as to be opposed to the fan entrance 13, and accordingly, a blow-out port non-opposed space S23 is formed as a space excluding the blow-out port opposed space S22 within the fan downwind space S21 so as not to be opposed to the blow-out port 12 but to be opposed to the blow-out port non-opposed surface part 27, Moreover, a blow-out port circumferential surface part 28 is herein provided so as to extend from the blow-out port 112 side end of the blow-out port non-opposed surface part 27 toward the blow-out port 12 along the opening direction B of the Fin entrance 13 and the opening direction C of the blow-out port 12. With the construction, an electric component compartment S3 is herein formed by the blow-out port non-opposed surface part 27, the blow-out port circumferential surface part 28, the first lateral part 23, the third lateral part 25, the fourth lateral part 26, and a part of the downstream lateral part 22 that is located closely to the first lateral part 23 and in which the blow-out port 12 is not formed. The electric component compartment S3 accommodates electric components 14 to be used for controlling devices that make up the air conditioning apparatus 1. Furthermore, a blow-out pathway region S24, having the same opening size as the blow-out port 12, is formed by a region located closely to the blow-out port 12 within the blow-out port opposed space S22, i.e., a space enclosed by the blow-out port circumferential surface part 28, the second lateral part 24, a part of the third lateral part 25 that is located closely to the second lateral part 24, and a part of the fourth lateral part 26 that is located closely to the second lateral part 24.

Moreover, an electric heater 6 is herein mounted in the fan downwind space S21 of the fan compartment 52 in order to heat air blown out to the fan downwind space S21 by the bladed wheel 51 of the centrifugal fan 5. The electric heater 6 is heating means for heating air flowing through the fan compartment S2 in a heating operation. A heating element assembly with coiled electric heating wires is herein employed as the electric heater 6 (heating means). The electric heater 6 (the heating means) is disposed in the blow-out port opposed space S22, i.e., a region opposed to the blow-out port 12 within the fan downwind space S21. More specifically, the electric heater 6 (the heating means) disposed in the blow-out pathway region S24 close to the blow-out port 12 within the blow-out port opposed space S22. It should be noted that the electric heater 6 (the heating means) is not limited to the heating element assembly with the coiled electric heating wires, and alternatively, may employ a variety of types of heater.

(2) Basic Action of Air Conditioning Apparatus

Next, a basic action of the air conditioning apparatus 1 will be explained with FIGS. 1 to 9.

In the air conditioning apparatus 1 having the aforementioned construction, the bladed wheel 51 of the centrifugal fan 5 is configured to be rotated by driving of the fan motor 59. This produces the flow of air passing through the interior of the casing 2 sequentially in the order of the intake port 11, the heat exchanger compartment S1, the fan entrance 13, the fan compartment S2 and the blow-out port 12.

Now in the cooling operation, air fed to the interior of the casing 2 through the intake port Ill flows into the heat exchanger compartment SI, and is cooled by the refrigerant flowing through the heat exchanger 4. Then, the air cooled by the heat exchanger 4 flows into the fan compartment 52 through the tan entrance 13 and is sucked into the bladed wheel 51 of the centrifugal fan 5. The air sucked into the bladed wheel 51 is blown out to the fan downwind space S21 located on the downwind side of the bladed wheel 51. The air blown out to the fan downwind space S21 is fed to the outside of the casing 2 through the blow-out port 12.

On the other hand, in the heating operation, air fed to the interior of the casing 2 through the intake port 11 flows into the heat exchanger compartment S1, and is heated by the refrigerant flowing through the heat exchanger 4. The air heated by the heat exchanger 4 flows into the fan compartment S2 through the fan entrance 13, and is sucked into the bladed wheel 51 of the centrifugal fan 5. The air sucked into the bladed wheel 51 is blown out to the fan downwind space S21 located on the downwind side of the bladed wheel 51. The air blown out to the fan downwind space S21 is further heated by the electric heater 6 (the heating means), and is then fed to the outside of the casing 2 through the blow-out ports 12.

(3) Construction for Enhancing Ventilation Performance of Centrifugal Fan

In the air conditioning apparatus 1 having the aforementioned construction, the centrifugal fan 5 having the rearward blades 53 is mounted in the fan compartment S2 having the fan entrance 13 bored in opposition to the blow-out port 12 such that the rotary shaft 52 (the rotary axis A) is oriented to the opening direction B of the fan entrance 13 and the opening direction C of the blow-out port 12.

In the positional arrangement of the centrifugal fan 5 in the fan compartment S2 as described above, immediately after blown out by the bladed wheel 51 of the centrifugal fan 5, air has a strong flow component directed in the radial direction. Hence, the radial flow component increases ventilation resistance in the fan compartment S2, and this serves as a cause of hindering enhancement in ventilation performance.

Therefore, it is demanded for the air conditioning apparatus 1 to enhance the ventilation performance of the centrifugal fan 5 in consideration of the tendency, as described above, that air has a strong flow component directed in the radial direction immediately after blown out by the bladed wheel 51.

Figure 10:
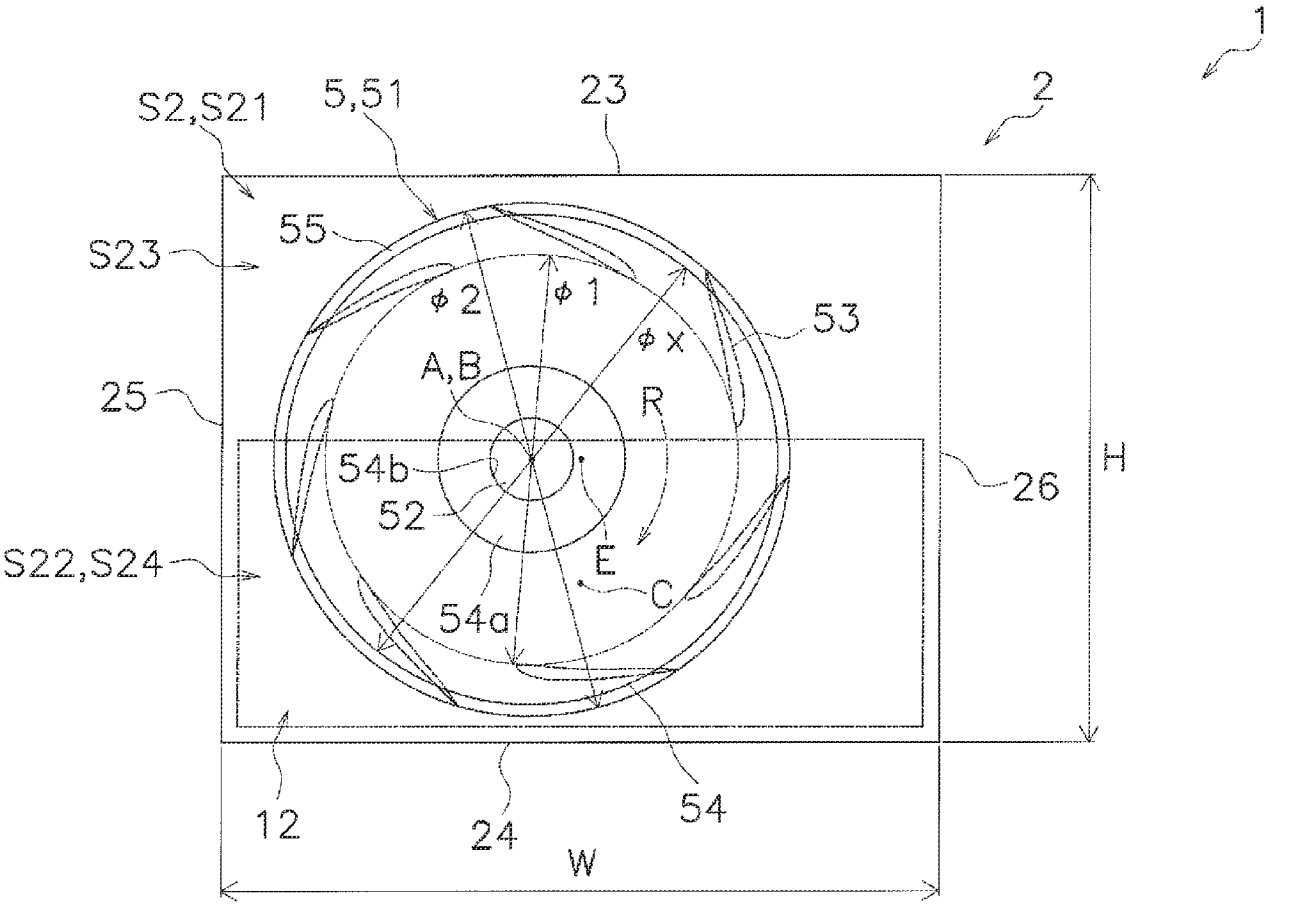
FIG. 10 is a cross-sectional view of FIG. 2 taken along line I-I.
Figure 11:
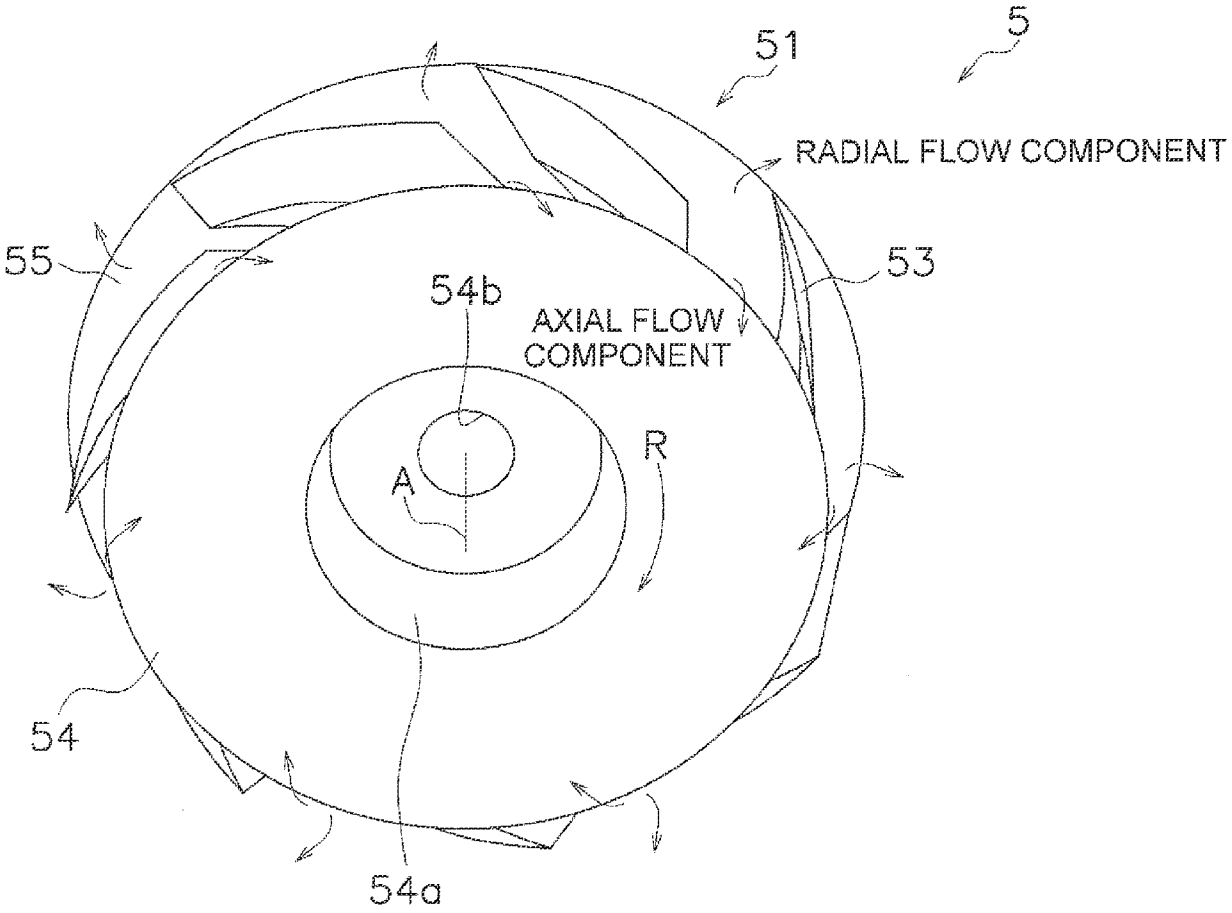
FIG. 11 is an external perspective view of the bladed wheel seen from a hub side.
Figure 12:
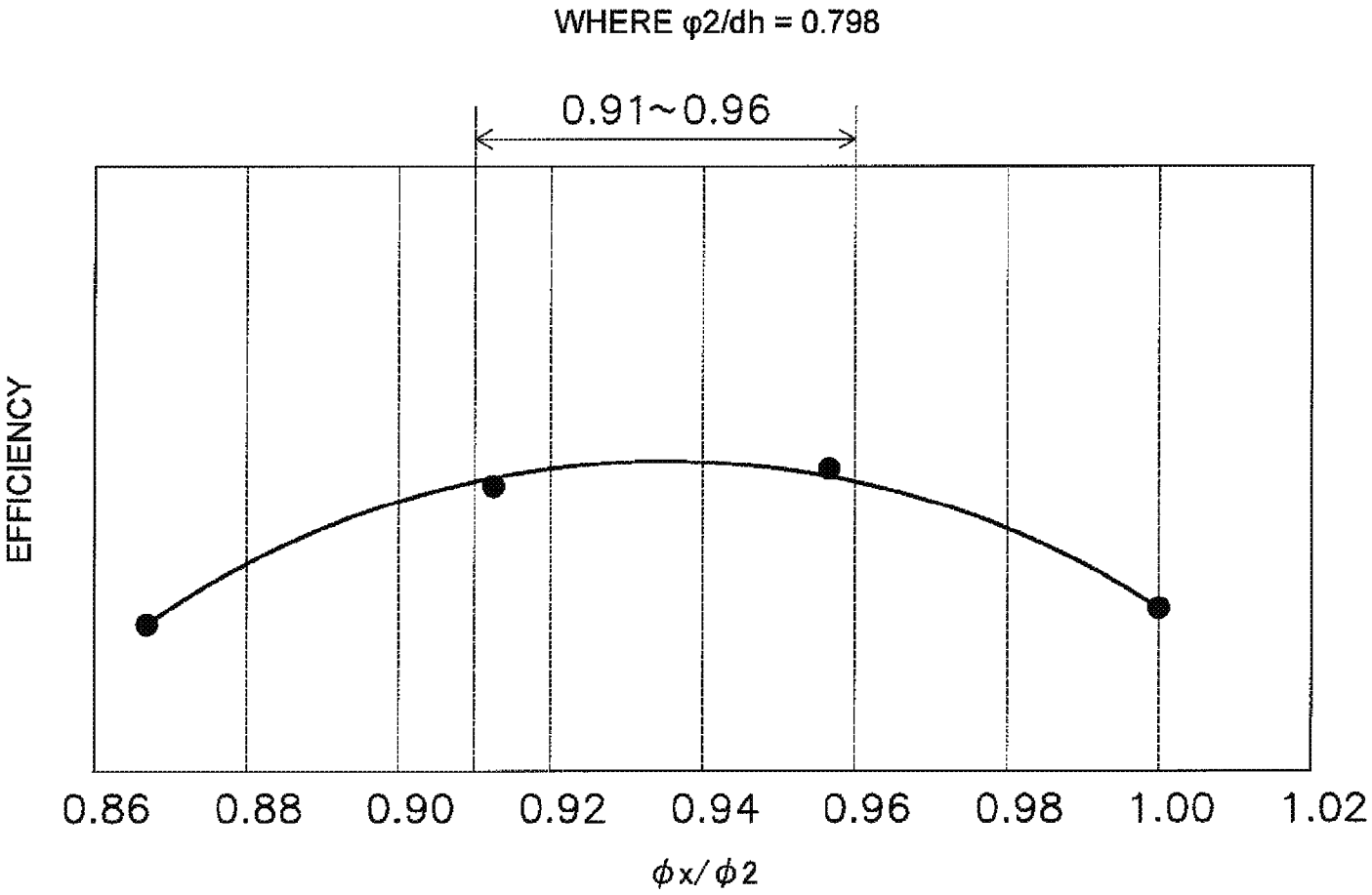
FIG. 12 is a chart representing a relation between the ratio of the outer diameter of the hub to the outer diameter of rearward blades and ventilation efficiency (where the ratio of the outer diameter of the rearward blades to the hydraulic diameter of a casing is 0.798)
Figure 13:
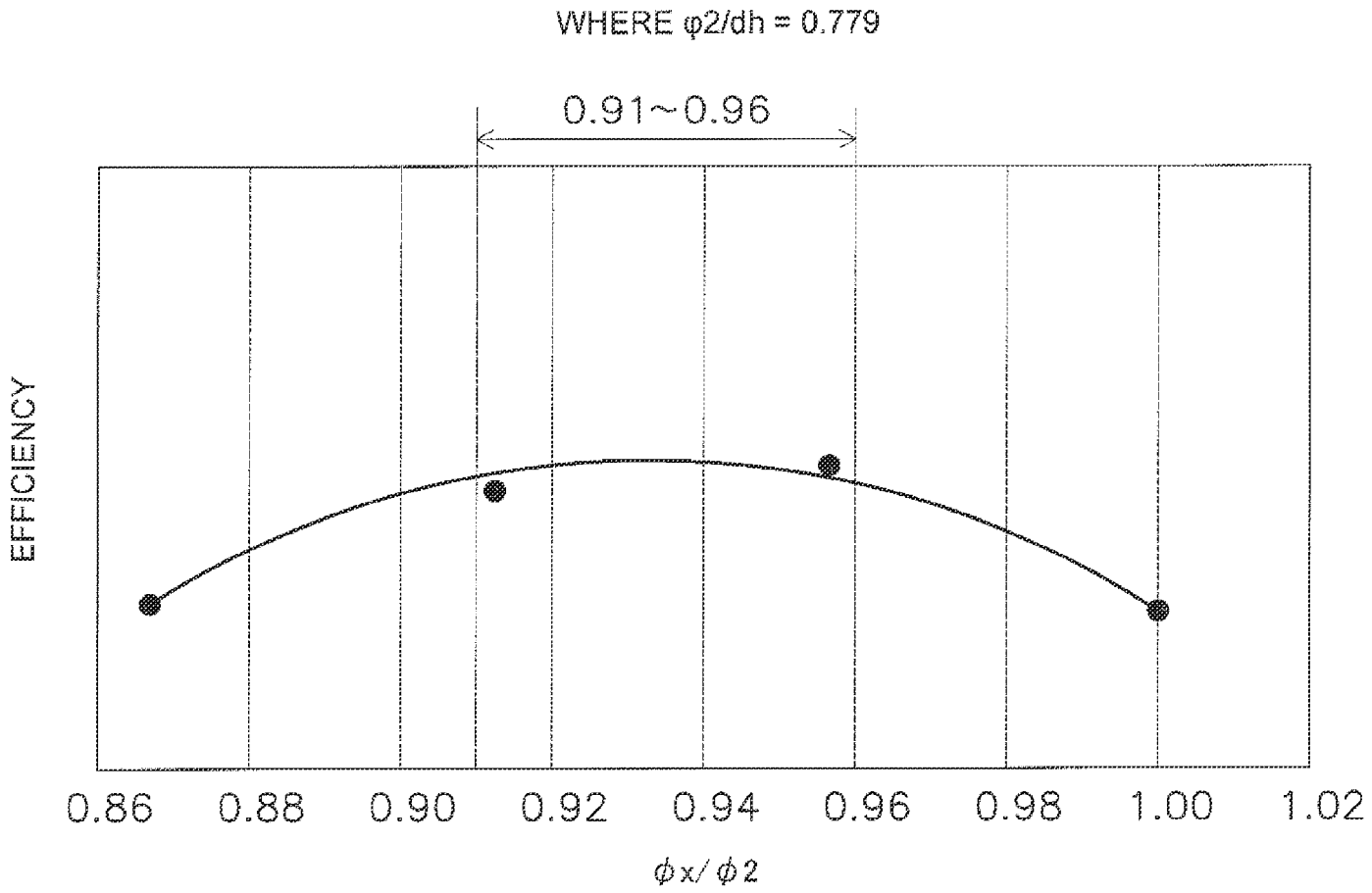
FIG. 13 is a chart representing a relation between the ratio of the outer diameter of the hub to the outer diameter of the rearward blades and ventilation efficiency (where the ratio of the outer diameter of the rearward blades to the hydraulic diameter of the casing is 0.779)
Figure 14:
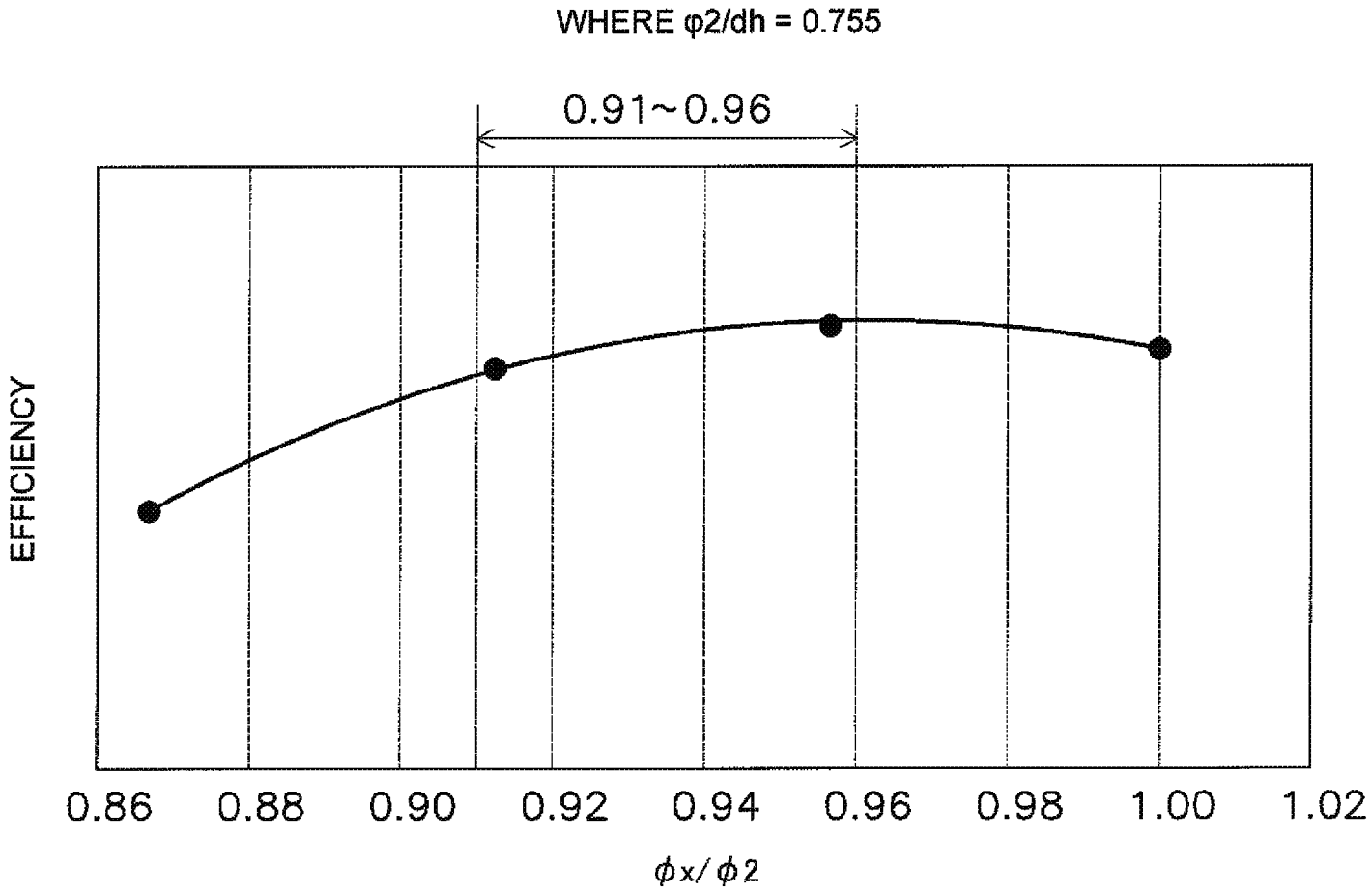
FIG. 14 is a chart representing a relation between the ratio of the outer diameter of the hub to the outer diameter of the rearward blades and ventilation efficiency (where the ratio of the outer diameter of the rearward blades to the hydraulic diameter of the casing is 0.755)
Figure 15:
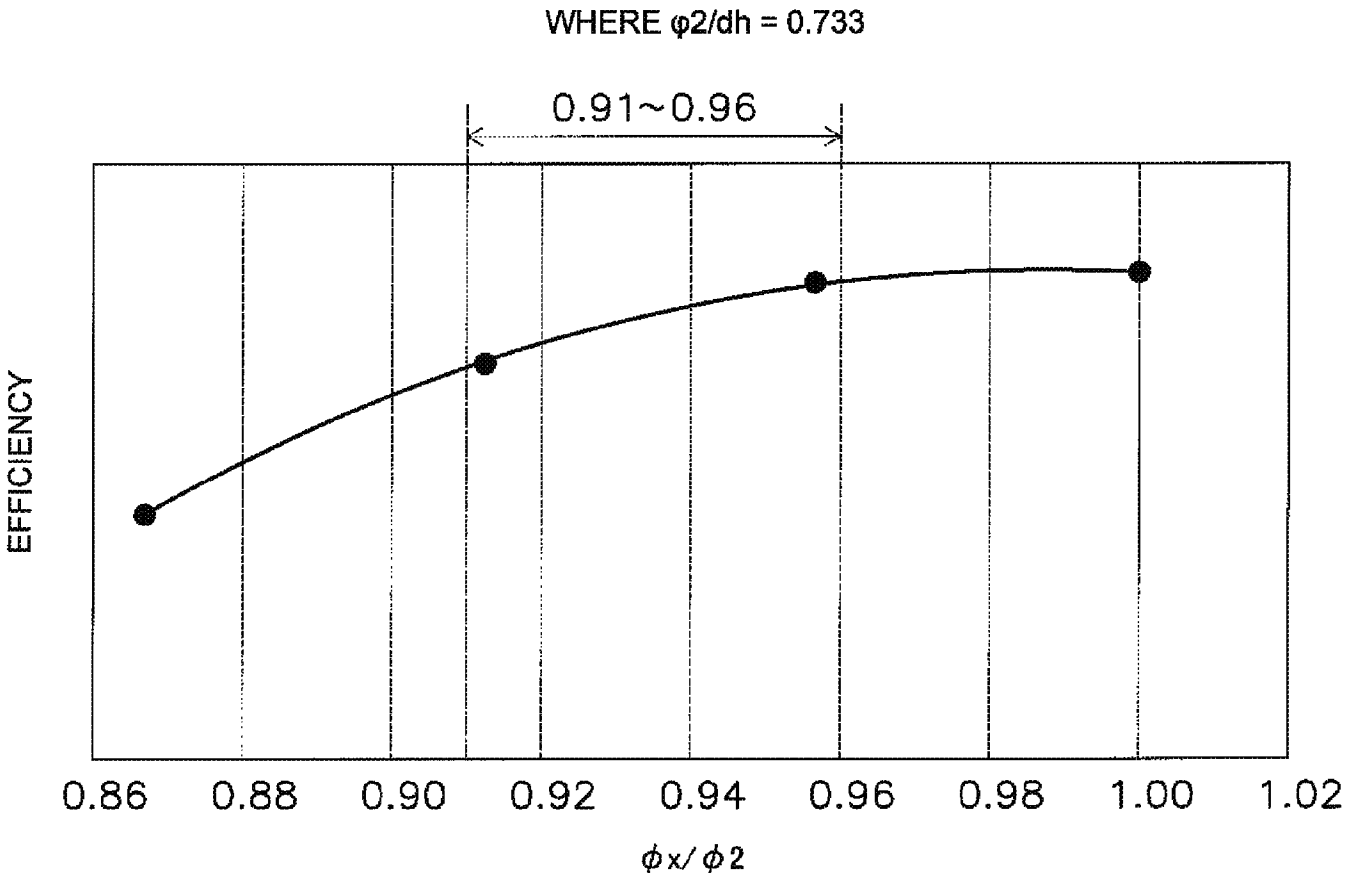
FIG. 15 is a chart representing a relation between the ratio of the outer diameter of the hub to the outer diameter of the rearward blades and ventilation efficiency (where the ratio of the outer diameter of the rearward blades to the hydraulic diameter of the casing is 0.733).

In view of the above, the bladed wheel 51 is herein contrived in shape. Specifically, as shown in FIGS. 7, 10 and 11, the bladed wheel 51 to be employed has a construction that an outer diameter ϕx of the hub 54 is set to be smaller than an outer diameter ϕ2 of the rearward blades 53 (the diameter of the outermost peripheral ends of the plural rearward blades 53). FIG. 10 is herein a cross-sectional view of FIG. 2 taken along line 14, whereas FIG. 11 is an external perspective view of the bladed wheel 51 seen from the hub 54 side.

Thus, a type of bladed wheel, having the construction that the outer diameter ϕx of the hub 54 is set to be smaller than the outer diameter ϕ2 of the rearward blades 53, is herein employed as the bladed wheel 51 of the centrifugal fan 5 that is mounted in the fan compartment 52 such that the rotary shaft 52 (the rotary axis A) is oriented to the opening direction B of the fan entrance 13 and the opening direction C of the blow-out port 12. With the construction, immediately after blown out by the bladed wheel 51 of the centrifugal fan 5, air can be herein strengthened in its flow component directed in the axial direction, and simultaneously; can be weakened in its flow component directed in the radial direction. Thus, the tendency of oblique flow can be strengthened.

Consequently, the ventilation resistance in the fan compartment S2 can be herein reduced, and the ventilation performance of the centrifugal fan 5 can be enhanced.

The extent to which the ventilation resistance in the fan compartment S2 is increased by the air that has just been blown out from the bladed wheel 51 of the centrifugal fan 5 is herein affected by the distance between the rearward blades 53 and the lateral parts 23 to 26 of the casing 2. Put differently, the ventilation resistance tends to increase with decrease in distance between the rearward blades 53 and the lateral parts 23 to 26 of the casing 2. On the other hand, the extent of oblique flow is affected by the outer diameter ϕx of the hub 54. Put differently, the tendency of Oblique flow can be strengthened with decrease in the outer diameter ϕx of the hub 54. It should be noted that when the outer diameter ϕx of the hub 54 is extremely small, the ventilation function of the rearward blades 54 itself is inevitably impaired. Due to the characteristics as described above, in employing the bladed wheel 51 having the construction that the outer diameter ϕx of the hub 54 is set to be smaller than the outer diameter ϕ2 of the rearward blades 53 (the diameter of the outermost peripheral ends of the plural rearward blades 53), it is preferable to achieve the tendency of oblique flow without impairing the ventilation function of the rearward blades 53 under the condition that the distance between the rearward blades 53 and the lateral parts 23 to 26 of the casing 2 is short.

In view of the above, in employing the bladed wheel 51 having the construction that the outer diameter ϕx of the hub 54 is set to be smaller than the outer diameter ϕ2 of the rearward blades 53 (the diameter of the outermost peripheral ends of the plural rearward blades 53), the outer diameter ϕx of the hub 54 is herein set to be 0.91 to 0.96 times the outer diameter ϕ2 of the rearward blades 53 under the condition that the outer diameter ϕ2 of the rearward blades 53 is greater than or equal to 0.75 times a hydraulic diameter dh of the lateral parts 23 to 26 of the casing 2 that enclose the outer peripheral side of the bladed wheel 51. When the casing 2 is seen from a direction along the rotary shaft 52 (the rotary axis A), the lateral parts 23 to 26 of the casing 2 have a quadrilateral cross-section, Hence, the hydraulic diameter dh of the casing 2 can be herein expressed by the following formula using a width W of the lateral part 23, 26 and a width H of the lateral part 24, 25. It should be noted that "W×H" indicates the cross-sectional area of the lateral parts 23 to 26 of the casing 2 that enclose the outer peripheral side of the bladed wheel 51, whereas "2×W+2×H" indicates the circumferential length of the lateral parts 23 to 26 of the casing 2 that enclose the outer peripheral side of the bladed wheel 51.

$$dh=4\times(W\times H)/(2\times W+2\times H)$$

Next, FIGS. 12 to 15 represent relations between the ratio of the outer diameter ϕx of the huh 54 to the outer diameter ϕ2 of the rearward blades 53 (=ϕx/ϕ2) and ventilation efficiency under various conditions regarding the ratio of the outer diameter ϕ2 of the rearward blades 53 to the hydraulic diameter dh of the casing 2 (=ϕ2/dh). According to the charts, the ventilation efficiency is maximized when ϕx/ϕ2 falls in a range of 0.91 to 0.96 under the condition that ϕ2/dh is greater than or equal to 0.75, put differently, that the distance between the rearward blades 53 and the lateral parts 23 to 26 of the casing 2 is short (see FIGS. 12 to 14). As a reason for this, it can be assumed that the tendency of oblique flow can be obtained by setting the outer diameter ϕx of the hub 54 to be smaller than the outer diameter ϕ2 of the rearward blades 53 such that ϕx/ϕ2 falls in a range of 0.91 to 0.96; ventilation resistance is thus inhibited by the tendency of oblique flow; and this results in enhancement in ventilation efficiency. On the other hand, the ventilation efficiency is not maximized when ϕx/ϕ2 falls in a range of 0.91 to 0.96 under the condition that ϕ2/dh is smaller than 0.75, put differently, that the distance between the rearward blades 53 and the lateral parts 23 to 26 of the casing 2 is long. The ventilation efficiency becomes higher by setting the outer diameter ϕx of the hub 54 not to be smaller than the outer diameter ϕ2 of the rearward blades 53 (ϕx/ϕ2=1.00) rather than by setting the outer diameter ϕx of the hub 54 to be smatter than the outer diameter ϕ2 of the rearward blades 53. As a reason for this, it can be assumed that the tendency of oblique flow can be obtained by setting the outer diameter ϕx of the huh 54 to be smaller than the outer diameter ϕ2 of the rearward blades 53 such that ϕx/ϕ2 falls in a range of 0.91 to 0.96; but even if the tendency of oblique flow could be obtained under the condition that ϕ2/dh is smaller than 0.75, put differently, that the distance between the rearward blades 53 and the lateral parts 23 to 26 of the casing 2 is long, the effect of inhibiting ventilation resistance is remarkably small and the adverse effect of impairing the ventilation function of the rearward blades 54, which is caused by setting the outer diameter ϕx of the hub 54 to be smaller than the outer diameter ϕ2 of the rearward blades 53, is relatively larger than the effect of inhibiting ventilation resistance. Thus, ϕ2/dh, ϕx/ϕ2 and the ventilation efficiency are closely related to each other. In consideration of the characteristics, it is preferable to appropriately set the sizes (W and H) of the lateral parts 23 to 26 of the casing 2, and it is more preferable to appropriately set the sizes (ϕx and ϕ2) of the hub 54 with respect to the rearward blades 53.

Consequently, in employing the bladed wheel 51 that the outer diameter ϕx of the hub 54 is set to be smaller than the outer diameter ϕ2 of the rearward blades 53, the ventilation performance of the centrifugal fan 5 can be herein effectively enhanced in view of the characteristics as described above.

Moreover, a length obtained by subtracting the outer diameter ϕx of the hub 54 from the outer diameter ϕ2 of the rearward blades 53 (=ϕ2−ϕx) is herein less than or equal to 0.4 times a chord length, which is a length obtained by subtracting an inner diameter ϕ1 of the rearward blades 53 (the diameter of the innermost peripheral ends of the plural rearward blades 53) from the outer diameter ϕ2 of the rearward blades 53 (=ϕ2−ϕ1), Thus, in employing the bladed wheel 51 that the outer diameter ϕx of the hub 54 is set to be smaller than the outer diameter ϕ2 of the rearward blades 53, the length (ϕ2−ϕx) obtained by subtracting the outer diameter ϕx of the hub 54 from the outer diameter ϕ2 of the rearward blades 53 is herein set to be less than or equal to 0.4 times the chord length (ϕ2−ϕ1).

Consequently, in employing the bladed wheel 51 that the outer diameter ϕx of the hub 54 is set to be smaller than the outer diameter ϕ2 of the rearward blades 53, the rearward blades 53 can be herein reliably supported by the huh 54 and the structural strength of the bladed wheel 51 can be enhanced.

(4) Modification

In the aforementioned bladed wheel 51 of the centrifugal fan 5, the outer diameter ϕx of the hub 54 is set to be smaller than the outer diameter ϕ2 of the rearward blades 53 in the entire circumferential direction of the hub 54. However, the setting of the outer diameter ϕx of the hub 54 is not limited to the above. For example, although not herein shown in the drawings, only parts of the hub 54, located between circumferentially adjacent ones of the plural rearward blades 53, may have an outer diameter smaller than the outer diameter ϕ2 of the rearward blades 53 when the bladed wheel 51 is seen from the direction along the rotary shaft 52 (the rotary axis A). It should be noted that the effect of strengthening the oblique flow is herein smaller than by setting the outer diameter ϕx of the hub 54 to be smaller than the outer diameter ϕ2 of the rearward blades 53 in the entire circumferential direction of the hub 54, and thus, the extent of enhancement in ventilation performance herein tends to be somewhat small.

The invention claimed is:

1. An air conditioning apparatus comprising:

a casing having an intake port and a blow-out port;

a partition member dividing an interior of the casing into a heat exchanger compartment located on an intake port side and a fan compartment located on a blow-out port side, the partition member having a fan entrance, the fan entrance being bored in opposition to the blow-out port and making the heat exchanger compartment and the fan compartment communicate with each other;

a heat exchanger mounted in the heat exchanger compartment; and a centrifugal fan including a bladed wheel having a plurality of rearward blades and being configured to suck air existing in the heat exchanger compartment into the fan compartment through the fan entrance, with the bladed wheel being mounted in the fan compartment such that a rotary shaft of the bladed wheel is oriented along an opening, direction of the fan entrance and an opening, direction of the blow-out port, the bladed wheel further including a hub connecting blow-out port side ends of the plural rearward blades and being configured to be rotated about the rotary shaft, the hub having an outer diameter smaller than an outer diameter of the rearward blades, the outer diameter of the rearward blades being at least 0.75 times a hydraulic diameter of lateral parts of the casing that enclose an outer peripheral side of the bladed wheel, and the outer diameterof the hub being 0.91 to 0.96 times the outer diameter of the rearward blades.

2. The air conditioning apparatus according to claim 1, wherein a length obtained by subtracting the outer diameter of the hub from the outer diameter of the rearward blades is no more than 0.4 times a chord length obtained by subtracting an inner diameter of the rearward blades from the outer diameter of the rearward blades.

* * * * *